US006289530B1

(12) United States Patent
Miller et al.

(10) Patent No.: US 6,289,530 B1
(45) Date of Patent: Sep. 18, 2001

(54) JETTED LAUNDRY/UTILITY/KITCHEN SINK

(75) Inventors: Robert A. Miller, Huntington Beach, CA (US); Jeff C. Henry, Duluth; Katherine R. Adams, Tucker, both of GA (US)

(73) Assignee: Mr. Tubs, Inc., Sugar Hill, GA (US)

( * ) Notice: Subject to any disclaimer, the term of this patent is extended or adjusted under 35 U.S.C. 154(b) by 0 days.

(21) Appl. No.: 09/549,022

(22) Filed: Apr. 13, 2000

Related U.S. Application Data

(60) Provisional application No. 60/129,188, filed on Apr. 14, 1999.

(51) Int. Cl.[7] ..... A47K 1/04

(52) U.S. Cl. ..... 4/619; 4/541.1; 4/541.3; 134/182; 134/188; 134/102.1

(58) Field of Search ..... 4/619, 621, 622, 4/541.1, 541.3, 541.4; 135/182, 183, 102.1, 188, 189

(56) References Cited

U.S. PATENT DOCUMENTS

| | | | | |
|---|---|---|---|---|
| 3,027,568 | | 4/1962 | Blau . | |
| 3,297,025 | * | 1/1967 | Jacuzzi | 4/541.4 |
| 3,890,656 | * | 6/1975 | Mathis | 4/178 |
| 4,047,522 | | 9/1977 | Plugge . | |
| 4,340,039 | * | 7/1982 | Hibbard et al. | 128/66 |
| 4,587,680 | | 5/1986 | Brugger . | |
| 4,761,838 | | 8/1988 | Hargrove . | |
| 4,979,245 | * | 12/1990 | Gandini | 4/542 |
| 5,862,545 | * | 1/1999 | Mathis et al. | 4/662 |

FOREIGN PATENT DOCUMENTS

| | | | | |
|---|---|---|---|---|
| 1592982 | * | 9/1977 | (GB) . | |
| 2146897-A | * | 5/1985 | (GB) | 4/541.4 |

* cited by examiner

*Primary Examiner*—Gregory L. Huson
*Assistant Examiner*—Huyen Le

(57) ABSTRACT

A jetted laundry/utility/kitchen sink provided with a plurality of water/air jets that introduce a pressurized flow of water/air into the interior of the sink. A motor/pump unit takes water from the interior of the sink, pressurizes the water, and returns the pressurized water to the interior of the sink via the nozzles. A flow diverting formation having a flow re-directing surface assists the nozzles in establishing a sustained circulation pattern within the sink.

14 Claims, 2 Drawing Sheets

JETTED LAUNDRY/UTILITY/KITCHEN SINK

CROSS REFERENCE TO PROVISIONAL PATENT APPLICATION

This application claims the benefit of the filing date of co-pending U.S. Provisional Patent Application No. 60,129,188 filed Apr. 14, 1999, the disclosure of which is incorporated herein by reference.

BACKGROUND OF THE INVENTION

The present invention relates to a jetted laundry/utility/kitchen sink and, more particularly, to a jetted sink for use in laundry, general utility, and in kitchen applications in which a pump-assisted water circulation pattern or patterns is optionally available to assist the user.

Various types of jetted bath tubs and spas have achieved wide-spread application in residential and commercial markets. In general, a water recirculation system is used to remove water from the tub and direct that water to the intake of a motor-driven pump where the water is pressurized and returned to the interior of the tub through one or more water jets. The water jets are often steerable and, in some case, can be controlled to form multiple sub-jets to provide various effects, including therapeutic benefits.

Conventional laundry/utility sinks as used in residential applications are filled with water and a cleaning agent (e.g., detergent or soap) and used to wash clothing items that are not suitable for machine washing or to pre-wash items prior to placement in a washing machine. In a similar manner, conventional kitchen sinks as used in residential applications merely provide a basin or reservoir that can be filled with water and a cleaning agent by the user to clean tableware, dishes, cups, and glassware, etc. or pre-rinse items prior to placement in a dishwasher. In all cases, the user must, if desired, manually agitate the retained water to assist the cleaning effect.

While conventional residential laundry/utility sinks and kitchen sinks adequately serve the needs of the user, the effectiveness of these sinks could be greatly enhanced if a sustained flow pattern could be established in the basin to assist in the cleaning function. In the context of a laundry/utility sink, the ability to create a sustained flow pattern within a laundry/utility sink would increase cleaning effectiveness for delicate clothing items that normally should not be subject to machine washing cycles. In the context of a kitchen sink, the ability to create a sustained flow pattern in the water filled basin would increase cleaning effectiveness for tableware, dishes, cups, and glassware, etc. and may decrease the need for a dishwasher. In most cases, a flow pattern that can be described as a gentle flow would be preferred, although, in some cases, a more agitated or turbulent flow pattern may also be desirable.

SUMMARY OF THE INVENTION

In view of the above, it is an object of the present invention, among others, to provide a laundry/utility/kitchen sink in which water contained within the sink is caused to flow in a flow pattern designed to assist in cleaning.

It is another object of the present invention to provide a jetted laundry/utility/kitchen sink in which water contained in the sink is subject to pressurized water jets to effect a flow pattern designed to assist in cleaning.

It is another object of the present invention to provide a jetted laundry/utility/kitchen sink in which water contained in the sink is subject to pressurized water jets to effect an optional turbulent churning or agitation.

It is still another object of the present invention to provide a jetted laundry/utility/kitchen sink in which water contained in the sink and a cleaning agent, such as a detergent or a soap, is caused to move in a sustained flow pattern by pressurizing the water and introducing the pressurized water into the sink through jets to create a desired flow pattern to thereby greatly increase the cleaning efficacy.

It is still a further object of the present invention to provide a jetted laundry/utility/kitchen sink in which water contained in the sink and a cleaning agent, such as a detergent or a soap, is subject to pressurized water jets to provide one of several available flow patterns.

In view of these objects, and others, the present invention provides a jetted laundry/utility/kitchen sink in which at least one and preferably a plurality of water nozzles are mounted in the sidewall of the sink to introduce pressurized water jets into the sink to create various types of swirling or whirling flow patterns and, if desired, turbulence or churning effects in the water to increase cleaning efficiency. A motor-driven pump withdraws water from the sink through a filtered intake and re-introduces that water into the sink through the at least one nozzle. The re-introduced water creates a highly beneficial agitation or churning of the water and any dissolved cleaning agent to increase cleaning efficiency.

The present invention advantageously provides a jetted laundry/utility/kitchen sink that beneficially creates one or more swirling or whirling flow patterns and, if desired, an agitation, churning, or turbulence in the water to greatly increase cleaning efficiency.

Other objects and further scope of applicability of the present invention will become apparent from the detailed description to follow, taken in conjunction with the accompanying drawings, in which like parts are designated by like reference characters.

DESCRIPTION OF THE PREFERRED EMBODIMENT

Figure 1:
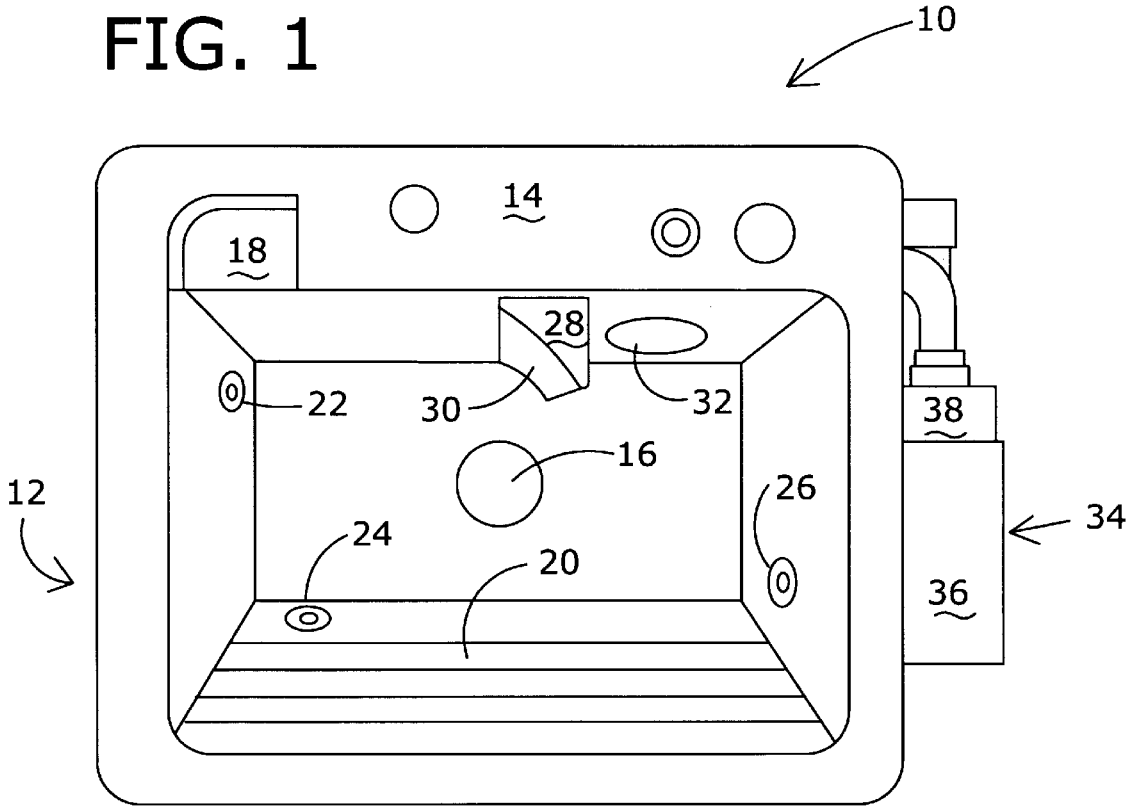
FIG. 1 is a plan view of an exemplary jetted sink in accordance with the present invention.

A jetted laundry/utility/kitchen sink system in accordance with the present invention is shown in FIG. 1 and designated generally therein by the reference character 10. As shown, the jetted sink system 10 is defined by a water-receiving sink 12, typically fabricated from a molded plastic (such as a cast LUCITE brand acrylic) in the case of a laundry or utility sink or pressed stainless steel in the case of a kitchen sink. The sink 12 includes a peripheral flange 14 and a conventional centrally located drain 16, which may optionally include a disposal unit (not shown) in the case of a kitchen sink. As shown on the left side of the rear portion of the flange 14, a soap dish 18 or equivalent receptacle can be integrally molded into the flange 14. Additionally, the front sidewall of the sink 12 can include washboard 20 surface in the case of laundry/utility sinks.

As shown on the left sidewall in FIG. 1, the front sidewall, and the right sidewall, the sink 12 is provided with jet-forming water nozzles 22, 24, and 26. The water nozzles 22, 24, and 26 are of conventional design and of the type used in the jetted bath/spa industry. The water nozzles 22, 24, and 26 may be of the type that can be steered or pointed by the user, opened or closed (i.e., turned ON or OFF) by the user, the type that aspirate air into the water jet, the type that produce pulsation jets, and/or the type of jet that produces multiple sub-jets. In the preferred embodiment, the water nozzles are "microjet" nozzles manufactured by Vico Manufacturing Products of S. El Monte Calif. 91733.

A flow diverting formation 28 is formed on or as part of the back side wall of the sink 12 and includes a flow re-directing surface 30, which, as described below, assists in establishing a circulation pattern within the sink 12 and minimizes the probability that any items in the sink 12, such as laundry items, will cover or block a water intake port 32 formed on the right side of the rear wall. The flow-redirecting surface 30 is preferably a curvilinear surface that can include a circular or elliptical profile.

Figure 2:
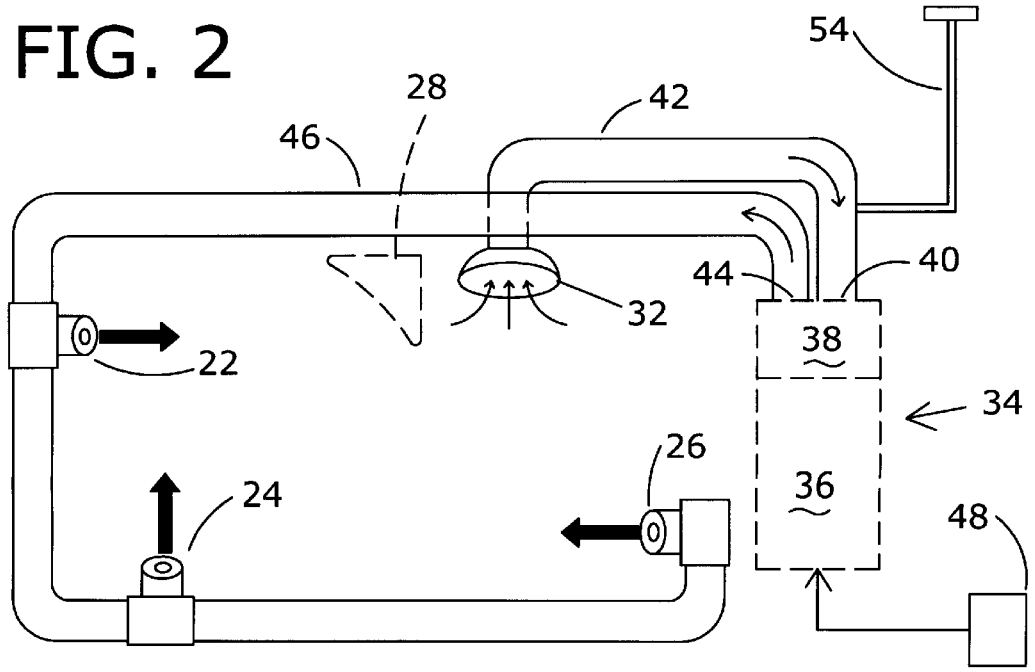
FIG. 2 is a plan view of a recirculating system used with the sink of FIG. 1.

FIG. 2 illustrates a preferred pump system for recirculating water within the sink 12 to establish a desired flow pattern. As shown, the system includes motor/pump unit 34 defined by a drive motor 36 and a connected pump 38 (shown in generic form in dotted-line illustration). The pump 38 includes an intake 40 connected to the water inlet port 32 by a suction return pipe 42, and an outlet 44 from which pump-pressurized water is provided by an outlet pipe 46 to the three nozzle assemblies 22, 24, and 26. In the preferred embodiment, the motor-pump unit 34 is the WOW! model motor/pump manufactured by Vico Manufacturing Products of S. El Monte Calif. 91733 and described more fully in U.S. patent application Ser. No. 09/345,407 filed Jul. 4, 1999, the disclosure of which is incorporated herein by reference. A user-controlled switch 48 is provided to turn the pump 38 on or off; optionally, the switch 48 can be the type that provide two or more operating speeds for the motor 36 or a continuously variable speed control. The operator-accessible switch 48 is of the pneumatic-type, as typically used in the bath/spa industry.

Figure 3:
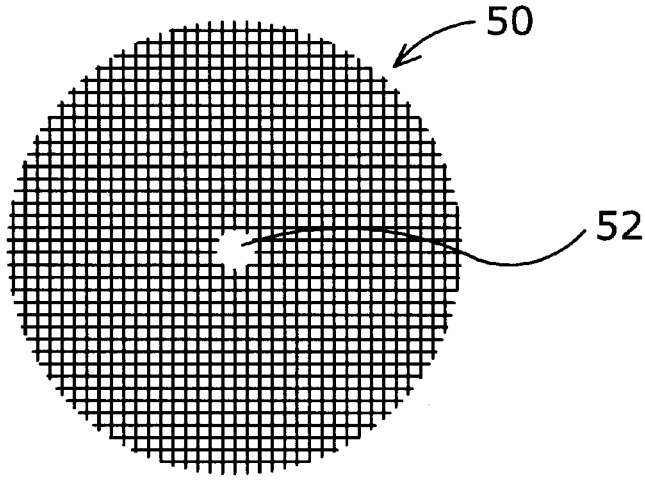
FIG. 3 is a plan view of a filter screen used with the recirculating system of FIG. 2.

The water intake port 32 includes a filter screen 50 (FIG. 3) that can take the form of a fine mesh (i.e., 20 mesh) metal (i.e., stainless steel, bronze, etc.) or plastic screen sufficient to screen water-borne particles from the recirculating water flow. The filter screen 50 includes a centrally hole 52 so that filter screen 50 can be mounted in place using a threaded fastener (not shown). The water intake port 32 can also include a simple plastic cover or cap (not specifically shown) to protect the filter screen 50.

The system optionally includes a user operable air-inlet control 54 that connects into the suction return pipe 42 to allow the user to introduce air into the recirculating water and thereby create water/air jets from the nozzles 22, 24, and 26.

Figure 4:
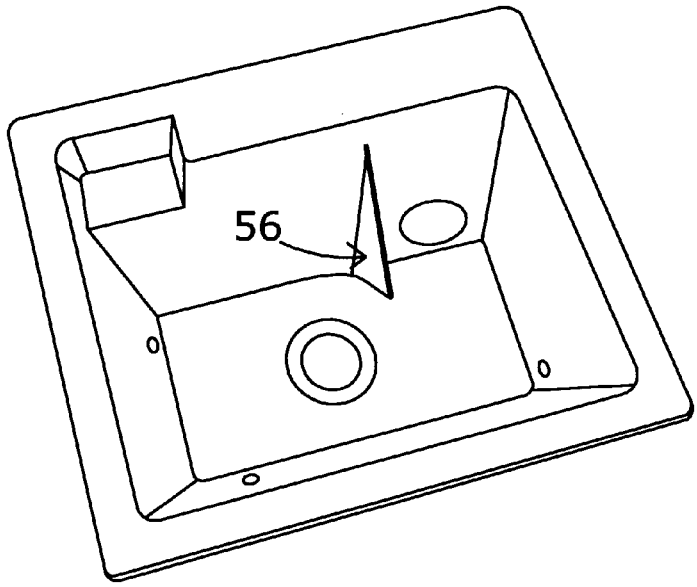
FIG. 4 is perspective view of sink having an alternative structure.

In the embodiment of FIG. 1, the flow diverting formation 28 is presented a block-like formation that extends from the rear wall of the sink 12. As can be appreciated by those skilled in the art, different flow diverters are possible and are within the scope of the present invention. For example and as shown in FIG. 4, a flow diverter can take the form a vane 56 that extends from the rear wall of the sink. Additionally, a plurality or flow diverting formations, vanes, and similar structures or surfaces can be utilized to assist in establishing the desired flow pattern within the sink 12.

Figure 5:
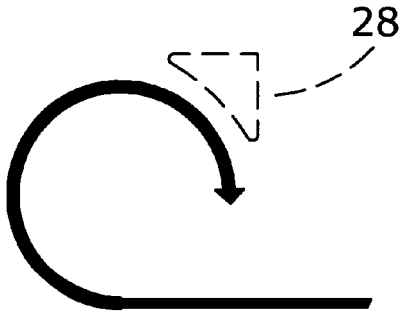
FIG. 5 is view of the preferred flow pattern of the sink of FIG. 1.

In use, the sink 12 is filled to an appropriate level with water from a conventional faucet mounted on the sink structure (not shown) and a cleaning agent optionally mixed into the water. Thereafter, the user turns the motor 36 on to start the recirculating flow. A jet-like flow of pressurized water is introduced by each nozzle 22, 24, 26 as indicated in FIG. 2. As shown in FIG. 5, the nozzle-jets create or induce a circular swirling or whirlpool flow pattern rotating in a clockwise direction with the flow diverting formation 28 directing the flow away from the water intake port 32. The flow diverting formation 28 thus functions to isolate the circular flow pattern from the water intake port 32. Since the front, side, and rear walls of the sink 12 are formed at an angle that converges toward the bottom of the sink 12, the water jets can also be directed upwardly in addition to inwardly.

In those situations in which the sink 12 is used to wash laundry items, the flow diverting formation 28 maximizes the probability that the laundry items remain in the circular flow pattern to the left of the flow diverting formation 28 and minimizes the probability that the laundry items will cover or block the water intake port 32. Once the washing is completed, the user turns off the motor 36 and opens the central drain 16 to drain the water from the sink 12.

The preferred embodiment of the present invention has been described in the context of a laundry or utility sink application. In those applications where bacteria formation is a concern, such as in kitchen sinks, a anti-bacterial agent can be introduced into the water. Optionally, the plastic components of the system can be fabricated from an anti-microbial plastic, such as the material disclosed in U.S. Pat. No. 5,919,554 and sold under the MICROBAN tradename.

In the embodiments described above, three nozzles have been described a creating the flow pattern. As can be appreciated, a greater or fewer number of nozzles can be used, the nozzles can be provided at different elevations from the bottom of the sink to provide multiple nozzle tiers. While the preferred embodiment provides a swirling flow pattern, as can be appreciated and as described in the above incorporated U.S. Provisional Patent Application 60/129,188 filed Apr. 14, 1999, the jets can be arranged to create an agitated turbulence or churning effect and the individual jets can be pulsed on and off by appropriate control. Additionally, plural water circuits, each with its own set of nozzles can be used in which a user-operable valve controls the fraction of water sent to one circuit or the other(s) to control the water flow pattern(s) formed within the sink.

The present invention advantageously provides a jetted sink suitable for use in laundry, utility, and kitchen applications in which water jets introduced into the sink create a desired flow pattern.

As will be apparent to those skilled in the art, various changes and modifications may be made to the illustrated jetted laundry/utility/kitchen sink of the present invention without departing from the spirit and scope of the invention as determined in the appended claims and their legal equivalent.

What is claimed is:

1. A jetted sink comprising:

a sink having at least first, second, and third water jet nozzles in sidewalls thereof to introduce first, second, and third pressurized water jets thereinto;

a motor-driven pump for accepting water from the sink through an input line, pressurizing that water, and returning that water through an output line to the first, second, and third water jet nozzles for re-introduction into the sink to establish a desired flow pattern within the sink;

a suction inlet in flow communication with said input line through which water from said sink flows to said motor-driven pump; and a flow diverter formation associated with the sink to divert flow thereacross to establish a flow pattern within said sink, said flow diverter formation fluidically separating said flow pattern from said suction inlet.

2. The jetted sink of claim 1, wherein said flow diverter formation includes a curvilinear flow re-directing surface.

3. The jetted sink of claim 1, wherein said flow diverter formation comprises a flow diverter vane associated with the sink to divert flow thereacross to establish a flow pattern within said sink.

4. The jetted sink of claim 1, each of said first, second, and third water jet nozzles are mounted on respective first, second, and third side walls of said sink.

5. The jetted sink of claim 1, further comprising means for introducing a flow of air into said pressurized water.

6. The jetted sink of claim 1, wherein said first, second, and third water jet nozzles establish a circular swirl flow-pattern within said sink.

7. The jetted sink of claim 1, further comprising a removable filter media in operative association with said suction inlet to filter material from the water flow therethrough.

8. The jetted sink of claim 7, wherein said removable filter media is a screen of sufficiently fine mesh to filter material from the water flow therethrough.

9. A jetted sink comprising:

a sink having a plurality of water jet nozzles in sidewalls thereof to introduce respective pressurized water jets thereinto;

a motor-driven pump for accepting water from the sink through an input line, pressurizing that water, and returning that water through an output line to the plurality of water jet nozzles for re-introduction into the sink to establish a desired flow pattern within the sink;

a suction inlet in flow communication with said inlet line through which water from said sink flows to said motor-driven pump; and a flow diverter formation associated with the sink to divert flow thereacross to establish a flow pattern within said sink, said flow diverter formation fluidically separating said flow pattern from said suction inlet.

10. The jetted sink of claim 9, wherein said flow diverter formation includes a curvilinear flow re-directing surface.

11. The jetted sink of claim 9, wherein said flow diverter formation comprises a flow diverter vane associated with the sink to divert flow thereacross to establish a flow pattern within said sink.

12. The jetted sink of claim 9, further comprising means for introducing a flow of air into said pressurized water.

13. The jetted sink of claim 9, wherein said water jet nozzles establish a circular swirl flow-pattern within said sink.

14. The jetted sink of claim 9, further comprising a removable filter media in operative association with said suction inlet to filter material from the water flow therethrough.

* * * * *